US006903058B2

(12) United States Patent
Nitsch et al.

(10) Patent No.: US 6,903,058 B2
(45) Date of Patent: Jun. 7, 2005

(54) DISHWASHING AGENT AND METHOD FOR PRODUCTION THEREOF

(75) Inventors: Christian Nitsch, Duesseldorf (DE); Bernd Richter, Leichlingen (DE); Rolf Bayersdoerfer, Duesseldorf (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 10/652,448

(22) Filed: Aug. 29, 2003

(65) Prior Publication Data

US 2004/0116319 A1 Jun. 17, 2004

Related U.S. Application Data

(63) Continuation of application No. PCT/EP02/01757, filed on Feb. 20, 2002.

(30) Foreign Application Priority Data

Mar. 1, 2001 (DE) ..... 101 09 799

(51) Int. Cl.[7] ..... C11D 1/66; C11D 3/37; C11D 17/00

(52) U.S. Cl. ..... 510/224; 510/229; 510/446; 510/476; 510/477; 510/489; 510/495

(58) Field of Search ..... 510/224, 229, 510/446, 476, 477, 489, 495

(56) References Cited

U.S. PATENT DOCUMENTS 4,814,102 A 3/1989 Baur et al.
5,958,855 A * 9/1999 Binstock et al. ..... 510/224
6,207,780 B1 3/2001 Stockhausen et al.

FOREIGN PATENT DOCUMENTS

| | | |
|---|---|---|
| CA | 2 038 332 | 9/1991 |
| DE | 37 43 739 A1 | 7/1989 |
| DE | 195 16 957 A1 | 11/1996 |
| DE | 199 34 704 A1 | 1/2001 |
| DE | 100 32 612 A1 | 2/2002 |
| EP | 0 451 508 A1 | 10/1991 |
| EP | 0 851 022 A2 | 7/1998 |

OTHER PUBLICATIONS

Rompp, Tenslometer, 9$^{th}$ Edition, vol. 6, p. 4440, Verlag Stuttgart, New York, no date given; not translated; no month given.

Vought, Lehrbuch der pharmazeutischen Technologie, 6yh Edition, pp. 182–184 (1987) not translated, no month given.

* cited by examiner

*Primary Examiner*—Brian P. Mruk
(74) *Attorney, Agent, or Firm*—Stephen D. Harper; Glenn E. J. Murphy

(57) ABSTRACT

Machine dishwashing agents containing a) 1 to 99.9% by weight of builder(s), and b) 0.1 to 70% by weight of copolymers of
   i) unsaturated carboxylic acids
   ii) monomers containing sulfonic acid groups, and
   iii) optionally further ionic or nonionogenic monomers, wherein the copolymer containing sulfonic acid groups is in particulate form, as well as methods of preparing the dishwashing agents.

47 Claims, No Drawings

DISHWASHING AGENT AND METHOD FOR PRODUCTION THEREOF

CROSS-REFERENCE TO RELATED APPLICATIONS

This is a continuation application under 35 U.S.C. § 365(c) of International Application No. PCT/EP02/01757, filed Feb. 20, 2002 in the European Patent Office, claiming priority under 35 U.S.C. § 119 of DE 101 09 799.9, filed Mar. 1, 2001 in the German Patent Office.

BACKGROUND OF THE INVENTION

The present invention relates to cleaners for machine dishwashing, in particular those cleaners that provide the advantages of a cleaner and a rinse aid in one product, and to production methods for such cleaners.

German patent application DE 100 32 612.9 discloses the use of copolymers of i) unsaturated carboxylic acids, ii) monomers containing sulfonic acid groups, and iii) optionally further ionic or nonionic monomers in machine dishwashing agents. Rinse aids and machine dishwashing agents that comprise such polymers are likewise described, which agents can be prepared in solid or liquid form, e.g. as powders, granules, extrudates, tablets, liquids, or gels.

Usually, polymers for the detergents and cleaners industry are sold in the form of aqueous solutions of concentrations between 30 and 60% by weight. These solutions can be used directly in the customary processing steps, for example granulation. The copolymers containing sulfonic acid groups described in DE 100 32 612.9 are processed in this way with great difficulty, since the corresponding solutions are considerably tacky and impair the formation of homogeneous, flowable mixtures. In addition, particulate products into which the polymer has been incorporated from its delivery form have a tendency to clump, thus lowering consumer acceptance, while tableted products have problems such as after-curing and poor dissolution properties.

These problems are further exacerbated in product forms that have been consumer- and wash-program-optimized by combining a number of conventional products. In order, for example, to provide cleaning products with rinse aid performance, large amounts of nonionic surfactants are needed. Such substances with low melting and softening points can likewise only be incorporated with extreme difficulty and make the additional incorporation of the copolymer in typical solution form virtually impossible. Incorporating relatively large amounts of copolymers containing sulfonic acid groups in the presence of relatively large amounts of readily melting compounds is therefore a problem that severely restricts the freedom to formulate.

It therefore was an object of the present invention to provide a solid machine dishwashing agent that comprises copolymers containing sulfonic acid groups in any amount, without giving rise to product problems such as clumping, after-curing, or poor dissolution properties. In addition, the aim was to provide a method that permits incorporating copolymers containing sulfonic acid groups into machine dishwashing agents in any desired amount, without the process safety being impaired or the production apparatuses becoming permanently contaminated.

It has now been found that the described problems can be solved if the copolymers containing sulfonic acid groups are added to the cleaners in particulate form. Surprisingly, the incorporation of the polymers within a certain particle size distribution is particularly advantageous. In this way, high amounts of polymer can also be incorporated into the cleaner in the presence of large amounts of readily meltable or softenable substances.

DESCRIPTION OF THE INVENTION

The present invention therefore provides, in a first embodiment, machine dishwashing agents which comprise a) 1 to 99.9% by weight of builder(s), and b) 0.1 to 70% by weight of copolymers of i) unsaturated carboxylic acids ii) monomers containing sulfonic acid groups, and iii) optionally further ionic or nonionogenic monomers, wherein the copolymer containing sulfonic acid groups is in particulate form.

A description of the copolymers containing sulfonic acid groups and of the monomers from which they are constructed follows:

For the purposes of the present invention, unsaturated carboxylic acids of the formula I are preferred as monomers, $$R^1(R^2)C{=}C(R^3)COOH \quad (I)$$

in which $R^1$ to $R^3$, independently of one another, are —H—$CH_3$, a straight-chain or branched saturated alkyl radical having 2 to 12 carbon atoms, a straight-chain or branched, mono- or polyunsaturated alkenyl radical having 2 to 12 carbon atoms, alkyl or alkenyl radicals as defined above and substituted by —$NH_2$, —OH or —COOH, or —COOH or —$COOR^4$, where $R^4$ is a saturated or unsaturated, straight-chain or branched hydrocarbon radical having 1 to 12 carbon atoms.

Among the unsaturated carboxylic acids that can be described by the formula I, particular preference is given to acrylic acid ($R^1$=$R^2$=$R^3$=H), methacrylic acid (($R^1$=$R^2$=H; $R^3$=$CH_3$), and/or maleic acid ($R^1$=COOH; $R^2$=$R^3$=H).

In the case of the monomers containing sulfonic acid groups, preference is given to those of the formula II, $$R^5(R^6)C{=}C(R^7)—X—SO_3H \quad (II),$$

in which $R^5$ to $R^7$, independently of one another, are —H—$CH_3$, a straight-chain or branched saturated alkyl radical having 2 to 12 carbon atoms, a straight-chain or branched, mono- or polyunsaturated alkenyl radical having 2 to 12 carbon atoms, alkyl or alkenyl radicals as defined above and substituted by —$NH_2$, —OH or —COOH, or —COOH or —$COOR^4$, where $R^4$ is a saturated or unsaturated, straight-chain or branched hydrocarbon radical having 1 to 12 carbon atoms, and X is an optionally present spacer group which is chosen from —$(CH_2)_n$—, where n=0 to 4, —COO—$(CH_2)_k$— where k=1 to 6, —C(O)—NH—$C(CH_3)_2$— and —C(O)—NH—$CH(CH_2CH_3)$—.

Among these monomers, preference is given to those of the formulae IIa, IIb and/or IIc, $$H_2C{=}CH—X—SO_3H \quad (IIa),$$

$$H_2C{=}C(CH_3)—X—SO_3H \quad (IIb),$$

$$HO_3S—X—(R^6)C{=}C(R^7)—X—SO_3H \quad (IIc),$$

in which $R^6$ and $R^7$, independently of one another, are chosen from —H, —$CH_3$, —$CH_2CH_3$, —$CH_2CH_2CH_3$, —$CH(CH_3)_2$ and X is an optionally present spacer group which is chosen from —$(CH_2)_n$—, where n=0 to 4, —COO—$(CH_2)_k$— where k=1 to 6, —C(O)—NH—$C(CH_3)_2$— and —C(O)—NH—$CH(CH_2CH_3)$—.

Particularly preferred monomers containing sulfonic acid groups here are 1-acrylamido-1-propanesulfonic acid (X=—

C(O)NH—CH($CH_2CH_3$) in formula IIa), 2-methacrylamido-2-propanesulfonic acid (X=—C(O)NH—C($CH_3$)$_2$ in formula IIa), 2-acrylamido-2-methyl-1-propanesulfonic acid (X=—C(O)NH—CH($CH_3$)$CH_2$— in formula IIa), 2-methacrylamido-2-methyl-1-propanesulfonic acid (X=—C(O)NH—CH($CH_3$)$CH_2$— in formula IIb), 3-methacrylamido-2-hydroxypropanesulfonic acid (X=—C(O)NH—$CH_2$CH(OH)$CH_2$— in formula IIb), allylsulfonic acid (X=$CH_2$ in formula IIa), methallylsulfonic acid (X=$CH_2$ in formula IIb), allyloxybenzenesulfonic acid (X=—$CH_2$—O—$C_6H_4$— in formula IIa), methallyloxybenzenesulfonic acid (X=—$CH_2$—O—$C_6H_4$— in formula IIb), 2-hydroxy-3-(2-propenyl-oxy)propanesulfonic acid, 2-methyl-2-propene-1-sulfonic acid (X=$CH_2$ in formula IIb), styrenesulfonic acid (X=$C_6H_4$ in formula IIa), vinylsulfonic acid (X not present in formula IIa), 3-sulfopropyl acrylate (X=—C(O)NH—$CH_2CH_2CH_2$— in formula IIa), 3-sulfopropyl methacrylate (X=—C(O)NH—$CH_2CH_2CH_2$— in formula IIb), sulfomethacrylamide (X=—C(O)NH— in formula IIb), sulfomethyl methacrylamide (X=—C(O)NH—$CH_2$— in formula IIb) and water-soluble salts of said acids.

Suitable further ionic or nonionogenic monomers are, in particular, ethylenically unsaturated compounds. Preferably the content of the monomers of group iii) in the polymers used according to the invention is less than 20% by weight, based on the polymer. Polymers to be used with particular preference consist merely of monomers of groups i) and ii).

The copolymers used according to the invention can comprise the monomers from groups i) and ii) and also optionally iii) in varying amounts, where all of the representatives from group i) can be combined with all of the representatives from group ii) and all of the representatives from the group iii). Particularly preferred polymers have certain structural units, which are described below.

Thus, for example, preference is given to machine dishwashing agents according to the invention which are characterized in that they comprise one or more copolymers which contain structural units of the formula III $$—[CH_2—CHCOOH]_m—[CH_2—CHC(O)—Y—SO_3H]_p— \quad (III),$$

in which m and p are in each case a whole natural number between 1 and 2000, and Y is a spacer group chosen from substituted or unsubstituted aliphatic, aromatic or araliphatic hydrocarbon radicals having 1 to 24 carbon atoms, where spacer groups in which Y is —O—$(CH_2)_n$— where n=0 to 4, is —O—($C_6H_4$)—, is —NH—C($CH_3$)$_2$— or —NH—CH($CH_2CH_3$)— are preferred.

These polymers are prepared by copolymerization of acrylic acid with an acrylic acid derivative containing sulfonic acid groups. Copolymerizing the acrylic acid derivative containing sulfonic acid groups with methacrylic acid leads to another polymer that likewise can be incorporated with preference into the agents according to the invention and contains structural units of the formula IV $$—[CH_2—C(CH_3)COOH]_m—[CH_2—CHC(O)—Y—SO_3H]_p— \quad (IV),$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms, where spacer groups in which Y is —O—$(CH_2)_n$—, where n=0 to 4, is —O—($C_6H_4$)—, is —NH—C($CH_3$)$_2$— or —NH—CH($CH_2CH_3$)— are preferred.

Analogously, acrylic acid and/or methacrylic acid can also be copolymerized with methacrylic acid derivatives containing sulfonic acid groups, as a result of which structural units in the molecule are changed. Copolymers which contain structural units of the formula V $$—[CH_2—CHCOOH]_m—[CH_2—C(CH_3)C(O)—Y—SO_3H]_p— \quad (V),$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms, where spacer groups in which Y is —O—$(CH_2)_n$—, where n=0 to 4, is —O—($C_6H_4$)—, is —NH—C($CH_3$)$_2$— or —NH—CH($CH_2CH_3$)— are preferably present in the agents according to the invention, as are copolymers which contain structural units of the formula VI $$—[CH_2—C(CH_3)COOH]_m—[CH_2—C(CH_3)C(O)—Y—SO_3H]_p— \quad (VI),$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms, where spacer groups in which Y is —O—$(CH_2)_n$—, where n=0 to 4, is —O—($C_6H_4$)—, is —NH—C($CH_3$)$_2$— or —NH—CH($CH_2CH_3$)— are preferred.

In place of acrylic acid and/or methacrylic acid, or in addition thereto, it is also possible to use maleic acid as particularly preferred monomer from group i). This gives agents preferred according to the invention which are characterized in that they comprise one or more copolymers which contain structural units of the formula VII $$—[HOOCCH—CHCOOH]_m—[CH_2—CHC(O)—Y—SO_3H]_p— \quad (VII),$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms, where spacer groups in which Y is —O—$(CH_2)_n$—, where n=0 to 4, is —O—($C_6H_4$)—, is —NH—C($CH_3$)$_2$— or —NH—CH($CH_2CH_3$)— are preferred, and gives agents which are characterized in that they comprise one or more copolymers which contain structural units of the formula VIII $$—[HOOCCH—CHCOOH]_m—[CH_2—C(CH_3)C(O)O—Y—SO_3H]_p— \quad (VIII),$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms, where spacer groups in which Y is —O—$(CH_2)_n$—, where n=0 to 4, is —O—($C_6H_4$)—, is —NH—C($CH_3$)$_2$— or —NH—CH($CH_2CH_3$)— are preferred.

In the polymers, all or some of the sulfonic acid groups can be present in neutralized form, i.e. the acidic hydrogen atom of the sulfonic acid group in some or all sulfonic acid groups can be replaced with metal ions, preferably alkali metal ions and in particular with sodium ions. Corresponding uses which are characterized in that the sulfonic acid groups in the copolymer are in partially or completely neutralized form are preferred in accordance with the invention.

Additionally suitable are also combinations of the sulfonated copolymers with heteroatom-containing polymers or copolymers, in particular those with amino or phosphono groups. Particular preference is given here to agents according to the invention which additionally comprise 0.1 to 30% by weight of homopolymeric and/or copolymeric polycarboxylic acids or salts thereof and/or heteroatom-containing polymers/copolymers, in particular those with amino or phosphono groups. Combination with polymers/copolymers containing amino and/or phosphono groups is advantageous in the case of builder systems which are only partially phosphate-based, e.g. phosphate/citrate mixed systems.

The monomer distribution in the copolymers containing sulfonic acid groups is, in the case of copolymers which comprise only monomers from groups i) and ii), preferably in each case 5 to 95% by weight of i) or ii), particularly preferably 50 to 90% by weight of monomer from group i) and 10 to 50% by weight of monomer from group ii), in each case based on the polymer.

In the case of terpolymers, particular preference is given to those which comprise 20 to 85% by weight of monomer from group i), 10 to 60% by weight of monomer from group ii), and 5 to 30% by weight of monomer from group iii).

The molar mass of the copolymers containing sulfonic acid groups can be varied in order to match the properties of the polymers to the desired intended use. Preferred copolymers containing sulfonic acid groups are characterized in that they have molar masses of from 2000 to 200 000 $gmol^{-1}$, preferably from 4000 to 25 000 $gmol^{-1}$ and in particular from 5000 to 15 000 $gmol^{-1}$.

According to the invention, the above-described copolymers containing sulfonic acid groups are used in particulate form. This means that the agents according to the invention comprise the copolymers containing sulfonic acid groups in the form of discrete, isolatable particles. These particles can consist entirely of the copolymers containing sulfonic acid groups, or be so-called compounds which additionally comprise other substances, for example carrier materials. A decisive factor for the success of the invention is the particulate form, which is only achieved through an addition in the form of a solid during the preparation process (see below). The conventional incorporation of the delivery form of the polymers as a solution leads to a distribution of the copolymers on the surface of all other particles present in the mixture (comparable with a "coating" of all particles with copolymer or copolymer solution) and thus to the problems described above during subsequent packaging and storage or during compression to give tablets.

"In particulate form" thus means that the agents according to the invention are a particle mixture (optionally compressed to give tablets or phases thereof) of a large number of particles (builders, optional bleaches, etc.), in which the copolymers containing sulfonic acid groups form one constituent of the particle matrix.

In preferred embodiments of the present invention, the particles of the copolymers containing sulfonic acid groups present in the agents satisfy certain criteria relating to particle size. Preference is given here to machine dishwashing agents according to the invention in which at least 50% by weight, preferably at least 60% by weight, particularly preferably at least 75% by weight and in particular at least 90% by weight of the particles of the copolymer containing sulfonic acid groups present in the agent have particle sizes above 200 $\mu$m.

The particle sizes or the fulfillment of the particle size criteria can be determined by sieving the polymer particles in the manner known to the person skilled in the art. In other words, for the preferred agents described above, this means that at least 50% by weight, preferably at least 60% by weight, particularly preferably at least 75% by weight and in particular at least 90% by weight, of the particles of the copolymer containing sulfonic acid groups present in the agent remain on sieves with a mesh width of 200 $\mu$m.

Preferably, the polymer particles are still coarser so that, for example, at least 50% by weight, preferably at least 60% by weight, particularly preferably at least 75% by weight and in particular at least 80% by weight, of the particles of the copolymer containing sulfonic acid groups present in the agent remain on sieves with a mesh width of 400 $\mu$m.

However, the particle size range is preferably also limited upward: in particularly preferred agents, the polymer has a particle size distribution in which at most 60% by weight, preferably at most 50% by weight and in particular at most 40% by weight, of the particles of the copolymer containing sulfonic acid groups present in the agent remain on sieves with a mesh width of 800 $\mu$m.

Coarse and fine fractions are preferably present only in minor amounts, so that preferred machine dishwashing agents are characterized in that at most 20% by weight, preferably at most 15% by weight and in particular at most 10% by weight, of the particles of the copolymer containing sulfonic acid groups present in the agent have particle sizes below 200 $\mu$m or above 1200 $\mu$m.

The particles of the copolymer containing sulfonic acid groups present according to the invention in the agents preferably have a certain water content. The provision of such particles which are controlled with regard to their water content allows the successes according to the invention to be increased yet further. Excessively high water contents of polymer particles can, for example, be readily lowered by drying in a manner known to the person skilled in the art. In particularly preferred machine dishwashing agents according to the invention, the water content of the particles of the copolymer containing sulfonic acid groups present in the agent is 3 to 12% by weight, preferably 4 to 11% by weight and in particular 5 to 10% by weight, in each case based on the copolymer particles. The water content of the polymer particles can be determined here in a simple manner by titration in accordance wth Karl Fischer.

The bulk density of the particles of the copolymer containing sulfonic acid groups present according to the invention in the agents is also preferably within a certain range. The bulk density here is understood as meaning the density of a loose charge, i.e. not the compacted density. Here, particular preference is given to machine dishwashing agents according to the invention in which the bulk density of the particles of the copolymer containing sulfonic acid groups present in the agent is 550 to 850 g/l, preferably 570 to 800 g/l, particularly preferably 590 to 750 g/l and in particular 600 to 720 g/l.

The amounts in which the copolymer(s) containing sulfonic acid groups is/are used are between 0.1 and 70% by weight, in each case based on the total agent. Particular preference is given here to machine dishwashing agents according to the invention which are characterized in that they comprise the copolymer(s) containing sulfonic acid groups in amounts of from 0.25 to 50% by weight, preferably from 0.5 to 35% by weight, particularly preferably from 0.75 to 20% by weight and in particular from 1 to 15% by weight.

The advantages according to the invention are in evidence particularly when the agents according to the invention comprise "tacky" substances in particular thus those substances which melt or soften below the application temperature of the agents and can thus lead to the problems mentioned at the beginning during preparation, during transportation and during storage. Preference is given here to machine dishwashing agents according to the invention which additionally comprise 2 to 40% by weight, preferably 3 to 30% by weight and in particular 5 to 20% by weight of one or more ingredients with a melting point or softening point below 60° C., where nonionic surfactant(s) is/are preferred.

Such ingredients with melting points or softening points below 60° C. can originate from a large number of classes of substance. Many of these ingredients do not exhibit a sharply defined melting point, as usually arises in the case of pure, crystalline substances, but a melting range which in some circumstances covers several degrees Celcius. In the case of the preferred agents described above, this is below 60° C., this limit not referring to the width of the melting range, but only to its "position". Preferably, the width of the melting range is at least 1° C., preferably about 2 to about 3° C.

The properties mentioned above are generally satisfied by so-called waxes. "Waxes" are understood as meaning a series of natural or artificially obtained substances which generally melt above 40° C. without decomposition, and are of relatively low viscosity and are non-stringing at just a little above the melting point. They have a highly temperature-dependent consistency and solubility. Depending on their origin, the waxes are divided into three groups: natural waxes, chemically modified waxes and synthetic waxes.

Natural waxes include, for example, plant waxes, such as candelilla wax, carnauba wax, Japan wax, esparto grass wax, cork wax, guaruma wax, rice germ oil wax, sugarcane wax, ouricury wax, or montan wax, animal waxes, such as beeswax, shellac wax, spermaceti, lanolin (wool wax), or uropygial grease, mineral waxes, such as ceresin or ozokerite (earth wax), or petrochemical waxes, such as petrolatum, paraffin waxes or microctystalline waxes.

Chemically modified waxes include, for example, hard waxes, such as montan ester waxes, sassol waxes or hydrogenated jojoba waxes.

Synthetic waxes are generally understood as meaning polyalkylene waxes or polyalkylene glycol waxes. Coating materials which can be used are also compounds from other classes of substance which satisfy said requirements with regard to the softening point. Suitable synthetic compounds have proven to be, for example, higher esters of phthalic acid, in particular dicyclohexyl phthalate, which is commercially available under the name Unimoll® 66 (Bayer AG). Also suitable are synthetically prepared waxes from lower carboxylic acids and fatty alcohols, for example dimyristyl tartrate, which is available under the name Cosmacol® ETLP (Condea). Conversely, synthetic or partially synthetic esters of lower alcohols with fatty acids from native sources may also be used. This class of substance includes, for example, Tegin® 90 (Goldschmidt), a glycerol monostearate palmitate.

Also covered by waxes for the purposes of the present invention are, for example, so-called wax alcohols. Wax alcohols are relatively high molecular weight, water-insoluble fatty alcohols having in general about 22 to 40 carbon atoms. The wax alcohols occur, for example, in the form of wax esters of relatively high molecular weight fatty acids (wax acids) as the major constituent of many natural waxes. Examples of wax alcohols are lignoceryl alcohol (1-tetracosanol), cetyl alcohol, myristyl alcohol or melissyl alcohol. The coating of the solid particles coated according to the invention can optionally also comprise wool wax alcohols, which are understood as meaning triterpenoid and steroid alcohols, for example lanolin, which is available, for example, under the trade name Argowax® (Parmentier & Co). As a constituent of the coating, it is also possible to use, at least proportionately, for the purposes of the present invention, fatty acid glycerol esters or fatty acid alkanolamides, but also, if desired, water-insoluble or only sparingly water-soluble polyalkylene glycol compounds.

The waxes described above can be incorporated into the agents for the delayed release of ingredients at a certain time in the cleaning cycle. Suitable for this purpose are, for example, also so-called "fatty substances", which can likewise have softening points or melting points below 60° C.

For the purposes of this application, fatty substances are understood as meaning substances which are solid at normal temperature (20° C.) from the group of fatty alcohols, fatty acids and fatty acid derivatives, in particular fatty acid esters. Fatty substances which can be used with preference according to the invention are fatty alcohols and fatty alcohol mixtures, fatty acids and fatty acid mixtures, fatty acid esters with alkanols or diols or polyols, fatty acid amides, fatty amines etc.

Preferred cleaner components comprise, as ingredient c), one or more substances from the group of fatty alcohols, fatty acids and fatty acid esters.

The fatty alcohols used are, for example, the alcohols, accessible from natural fats and oils, 1-hexanol (caproic alcohol), 1-heptanol (enanthic alcohol), 1-octanol (caprylic alcohol), 1-nonanol (pelargonic alcohol), 1-decanol (capric alcohol), 1-undecanol, 10-undecen-1-ol, 1-dodecanol (lauryl alcohol), 1-tridecanol, 1-tetradecanol (myristyl alcohol), 1-pentadecanol, 1-hexadecanol (cetyl alcohol), 1-heptadecanol, 1-octadecanol (stearyl alcohol), 9-cis-octadecen-1-ol (oleyl alcohol), 9-trans-octadecen-1-ol (erucyl alcohol), 9-cis-octadecene-1,12-diol (ricinol alcohol), all-cis-9,12-octadecadien-1-ol (linoleyl alcohol), all-cis-9,12,15-octadecatrien-1-ol (linolenyl alcohol), 1-nonadecanol, 1-eicosanol (arachidyl alcohol), 9-cis-eicosen-1-ol (gadoleyl alcohol), 5,8,11,14-eicosatetraen-1-ol, 1-heneicosanol, 1-docosanol (behenyl alcohol), 1,3-cis-docosen-1-ol (erucyl alcohol), 1,3-trans-docosen-1-ol (brassidyl alcohol), and mixtures of these alcohols. According to the invention it is possible to use Guerbet alcohols and oxo alcohols, for example $C_{13-15}$-oxo alcohols or mixtures of $C_{12-18}$-alcohols with $C_{12-14}$-alcohols as fatty substances without problems. It is of course also possible to use alcohol mixtures, however, for example those such as the $C_{16-18}$-alcohols prepared by ethylene polymerization according to Ziegler. Specific examples of alcohols which can be used as component c) are the alcohols already specified above, and lauryl alcohol, palmityl alcohol and stearyl alcohol and mixtures thereof.

Fatty acids are also fatty substances. These are obtained industrially in the main from natural fats and oils by hydrolysis. Whereas the alkaline saponification, which was carried out as early as in the previous century, led directly to the alkali metal salts (soaps), only water is used industrially nowadays for the hydrolysis, which hydrolyzes the fats into glycerol and the free fatty acids. Processes used industrially are, for example, hydrolysis in autoclaves or continuous high-pressure hydrolysis. For the purposes of the present invention, carboxylic acids which can be used as fatty substance are, for example, hexanoic acid (caproic acid), heptanoic acid (enanthic acid), octanoic acid (caprylic acid), nonanoic acid (pelargonic acid), decanoic acid (capric acid), undecanoic acid etc. For the purposes of the present invention, preference is given to the use of fatty acids, such as dodecanoic acid (lauric acid), tetradecanoic acid (myristic acid), hexadecanoic acid (palmitic acid), octadecanoic acid (stearic acid), eicosanoic acid (arachic acid), docosanoic acid (behenic acid), tetracosanoic acid (lignoceric acid), hexacosanoic acid (cerotinic acid), triacotanoic acid (melissic acid), and the unsaturated species 9c-hexadecenoic acid (palmitoleic acid), 6c-octadecenoic acid (petroselic acid), 6t-octadecenoic acid (petroselaidic acid), 9c-octadecenoic acid (oleic acid), 9t-octa-decenoic acid (elaidic acid), 9c,12c-octadecadienoic acid (linoleic acid), 9t,12t-octadecadienoic acid (linolaidic acid) and 9c,12c,15c-octadecatrienoic acid (linolenic acid). It is of course also possible to use tridecanoic acid, pentadecanoic acid, margaric acid, nonadecanoic acid, erucic acid, eleostearic acid and arachidonic acid. For reasons of cost, it is preferred to use not the pure species, but technical-grade mixtures of the individual acids, as are accessible from the hydrolysis of fat. Such mixtures are, for example, coconut oil fatty acid (about 6% by weight of $C_8$, 6% by weight of $C_{10}$, 48% by weight of $C_{12}$, 18% by weight of $C_{14}$, 10% by weight of $C_{16}$, 2% by weight of $C_{18}$, 8% by weight of $C_{18'}$, 1% by weight of $C_{18''}$), palm kernel oil fatty acid (about 4% by weight of $C_8$, 5% by weight of $C_{10}$, 50% by weight of $C_{12}$, 15% by weight of $C_{14}$, 7% by weight of $C_{16}$, 2% by weight of $C_{18}$, 15% by weight of $C_{18'}$, 1% by weight of $C_{18''}$), tallow fatty acid (about 3% by weight of $C_{14}$, 26% by weight of $C_{16}$, 2% by weight of $C_{16'}$, 2% by weight of $C_{17}$, 17% by weight of $C_{18}$, 44% by weight of $C_{18'}$, 3% by weight of $C_{18''}$, 1% by weight of $C_{18'''}$), hydrogenated tallow fatty acid (about 2% by weight of $C_{14}$, 28% by weight of $C_{16}$, 2% by weight of $C_{17}$, 63% by weight of $C_{18}$, 1% by weight of $C_{18}$), technical-grade oleic acid (about 1% by weight of $C_{12}$, 3% by weight of $C_{14}$, 5% by weight of $C_{16}$, 6% by weight of $C_{16'}$, 1% by weight of $C_{17}$, 2% by weight of $C_{18}$, 70% by weight of $C_{18'}$, 10% by weight of $C_{18''}$, 0.5% by weight of $C_{18'''}$), technical-grade palmitic/stearic acid (about 1% by weight of $C_{12}$, 2% by weight of $C_{14}$, 45% by weight of $C_{16}$, 2% by weight of $C_{17}$, 47% by weight of $C_{18}$, 1% by weight of $C_{18'}$), and soybean oil fatty acid (about 2% by weight of $C_{14}$, 15% by weight of $C_{16}$, 5% by weight of $C_{18}$, 25% by weight of $C_{18'}$, 45% by weight of $C_{18''}$, 7% by weight of $C_{18'''}$).

Fatty acid esters which can be used are the esters of fatty acids with alkanols, diols or polyols, preference being given to fatty acid polyol esters. Suitable fatty acid polyols esters are monoesters and diesters of fatty acids with certain polyols. The fatty acids which are esterified with the polyols are preferably saturated or unsaturated fatty acids having 12 to 18 carbon atoms, for example lauric acid, myristic acid, palmitic acid or stearic acid, preference being given to using the mixtures of fatty acids which are produced industrially, for example the acid mixtures derived from coconut fat, palm kernel fat or tallow fat. In particular, acids or mixtures of acids having 16 to 18 carbon atoms, such as, for example, tallow fatty acid, are suitable for esterification with the polyhydric alcohols. For the purposes of the present invention, suitable polyols which are esterified with the fatty acids mentioned above are sorbitol, trimethylolpropane, neopentyl glycol, ethylene glycol, polyethylene glycols, glycerol and polyglycerols.

The ingredients described above are usually only used when certain effects—e.g. the delayed release of ingredients—are to be achieved therewith. The agents according to the invention can, however, also comprise substances with melting or softening points which are generally present in the agents in order to improve the performance of the agents. Such substances are, in particular, nonionic surfactants.

The surfactants used in machine dishwashing agents are usually only low-foaming nonionic surfactants.

In particularly preferred embodiments of the present invention, the cleaner according to the invention comprises nonionic surfactants from the group of alkoxylated alcohols. Such nonionic surfactants used are preferably alkoxylated, advantageously ethoxylated, in particular primary, alcohols having preferably 8 to 18 carbon atoms and on average 1 to 12 mol of ethylene oxide (EO) per mole of alcohol, in which the alcohol radical may be linear or preferably methyl-branched in the 2 position, or may contain linear and methyl-branched radicals in the mixture, as are usually present in oxo alcohol radicals. In particular, however, preference is given to alcohol ethoxylates with linear radicals of alcohols of natural origin having 12 to 18 carbon atoms, e.g. from coconut alcohol, palm alcohol, tallow fatty alcohol or oleyl alcohol, and on average 2 to 8 EO per mole of alcohol. Preferred ethoxylated alcohols include, for example, $C_{12-14}$-alcohols with 3 EO or 4 EO, $C_{9-11}$-alcohol with 7 EO, $C_{13-15}$-alcohols with 3 EO, 5 EO, 7 EO or 8 EO, $C_{12-18}$-alcohols with 3 EO, 5 EO or 7 EO and mixtures of these, such as mixtures of $C_{12-14}$-alcohol with 3 EO and $C_{12-18}$-alcohol with 5 EO. The stated degrees of ethoxylation represent statistical average values which, for a specific product, may be an integer or a fraction. Preferred alcohol ethoxylates have a narrowed homolog distribution (narrow range ethoxylates, NRE). In addition to these nonionic surfactants, it is also possible to use fatty alcohols with more than 12 EO. Examples thereof are tallow fatty alcohol with 14 EO, 25 EO, 30 EO or 40 EO.

Further nonionic surfactants which can be used are preferably propoxylated and/or butoxylated nonionic surfactants, with the mixed alkoxylated, advantageously propoxylated and ethoxylated, nonionic surfactants being of particular importance. Also in the case of these nonionic surfactants, the C chain length in the alkyl radical is preferably 8 to 18 carbon atoms, with $C_{9-11}$-alkyl radicals, $C_{12-13}$-alkyl radicals and $C_{16-18}$-alkyl radicals being of particular importance. In this connection, preference is given in particular to nonionic surfactants which have been obtained from $C_{9-11}$- or $C_{12-13}$-oxo alcohols. In the case of the preferred nonionic surfactants, on average 1 to 20 mol of alkylene oxide (AO) are used per mole of alcohol, where AO is the sum of EO and PO. Particularly preferred nonionic surfactants of this group contain 1 to 5 mol of PO and 5 to 15 mol of EO. A particularly preferred representative of this group is a $C_{12-20}$-oxo alcohol alkoxylated with 2 PO and 15 EO which is available under the trade name Plurafac® LF 300 (BASF).

Instead of PO groups, or in addition thereto, preferred nonionic surfactants can also have butylene oxide groups. Here, the alkyl radicals mentioned above, in particular the oxo alcohol radicals, are again preferred. The number of BO groups in preferred nonionic surfactants is 1, 2, 3, 4 or 5, where the total number of alkylene oxide groups is preferably in the range from 10 to 25. A particularly preferred representative of this group is available under the trade name Plurafac® LF 221 (BASF) and can be described by the formula $C_{13-15}$—O-$(EO)_{9-10}(BO)_{1-2}$.

In addition, further nonionic surfactants which may be used are also alkyl glycosides of the general formula RO $(G)_x$, in which R is a primary straight-chain or methyl-branched, in particular methyl-branched in the 2 position, aliphatic radical having 8 to 22 carbon atoms, preferably 12 to 18 carbon atoms, and G is the symbol which stands for a glycose unit with 5 or 6 carbon atoms, preferably glucose. The degree of oligomerization x, which gives the distribution of monoglycosides and oligoglycosides, is any desired number between 1 and 10; preferably x is 1.2 to 1.4.

A further class of preferably used nonionic surfactants, which are used either as the sole nonionic surfactant or in combination with other nonionic surfactants, are alkoxylated, preferably ethoxylated or ethoxylated and propoxylated fatty acid alkyl esters, preferably having 1 to 4 carbon atoms in the alkyl chain, in particular fatty acid methyl esters.

Nonionic surfactants of the amine oxide type, for example N-cocoalkyl-N,N-dimethylamine oxide and N-tallow-alkyl-N,N-dihydroxyethylamine oxide, and of the fatty acid alkanolamide type, may also be suitable. The amount of these nonionic surfactants is preferably not more than that of the ethoxylated fatty alcohols, in particular not more than half thereof.

Further suitable surfactants are polyhydroxy fatty acid amides of the formula (IX)

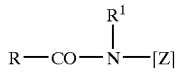

(IX)

in which RCO is an aliphatic acyl radical having 6 to 22 carbon atoms, $R^1$ is hydrogen, an alkyl or hydroxyalkyl radical having 1 to 4 carbon atoms and [Z] is a linear or branched polyhydroxyalkyl radical having 3 to 10 carbon atoms and 3 to 10 hydroxyl groups. The polyhydroxy fatty acid amides are known substances which are customarily obtained by reductive amination of a reducing sugar with ammonia, an alkylamine or an alkanolamine, and subsequent acylation with a fatty acid, a fatty acid alkyl ester or a fatty acid chloride.

The group of polyhydroxy fatty acid amides also includes compounds of the formula (X)

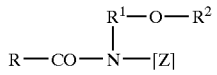

(X)

in which R is a linear or branched alkyl or alkenyl radical having 7 to 12 carbon atoms, $R^1$ is a linear, branched or cyclic alkyl radical or an aryl radical having 2 to 8 carbon atoms, and $R^2$ is a linear, branched or cyclic alkyl radical or an aryl radical or an oxy-alkyl radical having 1 to 8 carbon atoms, where $C_{1-4}$-alkyl or phenyl radicals are preferred and [Z] is a linear polyhydroxyalkyl radical whose alkyl chain is substituted by at least two hydroxyl groups, or alkoxylated, preferably ethoxylated or propoxylated, derivatives of said radical.

[Z] is preferably obtained by reductive amination of a reduced sugar, for example glucose, fructose, maltose, lactose, galactose, mannose or xylose. The N-alkoxy- or N-aryloxy-substituted compounds may then be converted into the desired polyhydroxy fatty acid amides by reaction with fatty acid methyl esters in the presence of an alkoxide as catalyst.

In the case of the cleaners according to the invention for machine dishwashing, it is particularly preferred that they comprise a nonionic surfactant which has a melting point above room temperature. Here, preference is given to machine dishwashing agents which comprise nonionic surfactant(s) with a melting point above 20° C., preferably above 25° C., particularly preferably between 25 and 60° C. and in particular between 26.6 and 43.3° C., in amounts of from 5.5 to 20% by weight, preferably from 6.0 to 17.5% by weight, particularly preferably from 6.5 to 15% by weight, and in particular from 7.0 to 12.5% by weight, in each case based on the total agent.

Suitable nonionic surfactants which have melting points or softening points within the stated temperature range are, for example, low-foaming nonionic surfactants which may be solid or highly viscous at room temperature. If nonionic surfactants which are highly viscous at room temperature are used, then it is preferred that they have a viscosity above 20 Pas, preferably above 35 Pas, and in particular above 40 Pas. Nonionic surfactants which have a wax-like consistency at room temperature are also preferred.

Preferred nonionic surfactants that are solid at room temperature originate from the groups of alkoxylated nonionic surfactants, in particular ethoxylated primary alcohols and mixtures of these surfactants with surfactants of more complex structure, such as polyoxypropylene/polyoxyethylene/polyoxypropylene (PO/EO/PO) surfactants, Such (PO/EO/PO) nonionic surfactants are characterized, moreover, by good foam control.

In a preferred embodiment of the present invention, the nonionic surfactant with a melting point above room temperature is an ethoxylated nonionic surfactant originating from the reaction of a monohydroxyalkanol or alkylphenol having 6 to 20 carbon atoms with preferably at least 12 mol, particularly preferably at least 15 mol, in particular at least 20 mol, of ethylene oxide per mole of alcohol or alkylphenol. Corresponding machine dishwashing agents, which are characterized in that the nonionic surfactant(s) is/are ethoxylated nonionic surfactant(s) which has (have) been obtained from $C_{6-20}$-monohydroxyalkanols or $C_{6-20}$-alkylphenols or $C_{16-20}$-fatty alcohols and more than 12 mol, preferably more than 15 mol and in particular more than 20 mol, of ethylene oxide per mole of alcohol are accordingly preferred.

A particularly preferred nonionic surfactant that is solid at room temperature is obtained from a straight-chain fatty alcohol having 16 to 20 carbon atoms ($C_{16-20}$-alcohol), preferably a $C_{18}$-alcohol and at least 12 mol, preferably at least 15 mol and in particular at least 20 mol, of ethylene oxide. Of these, the so-called "narrow range ethoxylates" (see above) are particularly preferred.

The nonionic surfactant which is solid at room temperature preferably additionally has propylene oxide units in the molecule. Preferably, such PO units account for up to 25% by weight, particularly preferably up to 20% by weight and in particular up to 15% by weight, of the overall molar mass of the nonionic surfactant. Machine dishwashing agents which comprise ethoxylated and propoxylated nonionic surfactants in which the propylene oxide units in the molecule account for up to 25% by weight, preferably up to 20% by weight and in particular up to 15% by weight, of the overall molar mass of the nonionic surfactant are preferred embodiments of the present invention. Particularly preferred nonionic surfactants are ethoxylated monohydroxyalkanols or alkylphenols which additionally have polyoxyethylene-polyoxypropylene block copolymer units. The alcohol or alkylphenol moiety of such nonionic surfactant molecules accounts for preferably more than 30% by weight, particularly preferably more than 50% by weight and in particular more than 70% by weight, of the overall molar mass of such nonionic surfactants.

Further nonionic surfactants with melting points above room temperature which can particularly preferably be used comprise 40 to 70% of a polyoxypropylene/polyoxyethylene/polyoxypropylene block polymer blend which comprises 75% by weight of an inverted block copolymer of polyoxyethylene and polyoxypropylene with 17 mol of ethylene oxide and 44 mol of propylene oxide and 25% by weight of a block initiated with trimethylolpropane and comprising 24 mol of ethylene oxide and 99 mol of propylene oxide per mole of trimethylolpropane.

Nonionic surfactants which may be used with particular preference are available, for example, under the name Poly Tergent® SLF-18 from Olin Chemicals.

A further preferred surfactant may be described by the formula $$R^1O[CH_2CH(CH_3)O]_x[CH_2CH_2O]_y[CH_2CH(OH)R^2]$$

in which $R^1$ is a linear or branched aliphatic hydrocarbon radical having 4 to 18 carbon atoms or mixtures thereof, $R^2$ is a linear or branched hydrocarbon radical having 2 to 26 carbon atoms or mixtures thereof, and x represents values between 0.5 and 1.5 and y represents a value of at least 15. Machine dishwashing agents which are characterized in that they comprise nonionic surfactants of the formula $$R^1O[CH_2CH(CH_3)O]_x[CH_2CH_2O]_y[CH_2CH(OH)R^2]$$

in which $R^1$ is a linear or branched aliphatic hydrocarbon radical having 4 to 18 carbon atoms or mixtures thereof, $R^2$ is a linear or branched hydrocarbon radical having 2 to 26 carbon atoms or mixtures thereof, and x represents values between 0.5 and 1.5 and y represents a value of at least 15, are therefore preferred.

Further nonionic surfactants which can preferably be used are the terminally capped poly(oxyalkylated) nonionic surfactants of the formula $$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals having 1 to 30 carbon atoms, $R^3$ is H or a methyl, ethyl, n-propyl, isopropyl, n-butyl, 2-butyl or 2-methyl-2-butyl radical, x represents values between 1 and 30, k and j represent values between 1 and 12, preferably between 1 and 5. If the value x is $\geqq 2$, each $R^3$ in the above formula may be different. $R^1$ and $R^2$ are preferably linear or branched, saturated or unsaturated, aliphatic or aromatic hydrocarbon radicals having 6 to 22 carbon atoms, radicals having 8 to 18 carbon atoms being particularly preferred. For the radical $R^3$, H, $—CH_3$ or $—CH_2CH_3$ are particularly preferred. Particularly preferred values for x are in the range from 1 to 20, in particular from 6 to 15.

As described above, each $R^3$ in the above formula may be different if x is $\geqq 2$. By this means it is possible to vary the alkylene oxide unit in the square brackets. If x, for example, is 3, the radical $R^3$ may be selected in order to form ethylene oxide ($R^3$=H) or propylene oxide ($R^3$=$CH_3$) units, which may be added onto one another in any sequence, examples being (EO) (PO) (EO), (EO) (EO) (PO), (EO) (EO) (EO), (PO) (EO) (PO), (PO) (PO) (EO) and (PO) (PO) (PO). The value 3 for x has been chosen here by way of example and it is entirely possible for it to be larger, the scope for variation increasing with increasing values of x and embracing, for example, a large number of (EO) groups, combined with a small number of (PO) groups, or vice versa.

Particularly preferred terminally capped poly (oxyalkylated) alcohols of the above formula have values of k=1 and j=1, thereby simplifying the above formula to $$R^1O[CH_2CH(R^3)O]_xCH_2CH(OH)CH_2OR^2$$

In the last-mentioned formula, $R^1$, $R^2$ and $R^3$ are as defined above and x stands for numbers from 1 to 30, preferably from 1 to 20 and in particular from 6 to 18. Particular preference is given to surfactants in which the radicals $R^1$ and $R^2$ have 9 to 14 carbon atoms, $R^3$ is H, and x assumes values from 6 to 15.

In summary, preference is given to machine dishwashing agents which contain terminally capped poly(oxyalkylated) nonionic surfactants of the formula $$R^1O[CH_2CH(R^3)O]_x[CH(OH)[CH_2]_jOR^2$$

in which $R^1$ and $R^2$ are linear or branched, saturated or unsaturated, aliphatic or aromatic hydrocarbon radicals having 1 to 30 carbon atoms, $R^3$ is H or a methyl, ethyl, n-propyl, isopropyl, n-butyl, 2-butyl or 2-methyl-2-butyl radical, x represents values between 1 and 30, k and j are values between 1 and 12, preferably between 1 and 5, where surfactants of the type $$R^1O[CH_2CH(R^3)O]_xCH_2CH(OH)CH_2OR^2$$

in which x represents numbers from 1 to 30, preferably from 1 to 20 and in particular from 6 to 18, are particularly preferred.

Particular preference is given to using mixtures of different nonionic surfactants in the dishwashing agents according to the invention. Particular preference is given here to particulate machine dishwashing agents which have a content of a) 1.0 to 4.0% by weight of nonionic surfactants from the group of alkoxylated alcohols, b) 4.0 to 24.0% by weight of nonionic surfactants from the group of alkoxylated alcohols containing hydroxyl groups ("hydroxy mixed ethers").

The nonionic surfactants from group a) have already been described in detail above where, for machine dishwashing agents which comprise the abovementioned mixtures, $C_{12-14}$-fatty alcohols with 5 EO and 4 PO and $C_{12-18}$-fatty alcohols with on average 9 EO have proven to be particularly outstanding. With similar preference, it is also possible to use terminally capped nonionic surfactants, in particular $C_{12-18}$-fatty alcohol-9 EO butyl ethers.

Surfactants from group b) exhibit excellent rinse aid effects and reduce the stress corrosion cracking in plastics. Furthermore, they have the advantageous property that their wetting behavior is constant over the entire customary temperature range. Particular preference is given to surfactants from group b) alkoxylated alcohols containing hydroxyl groups. All of the hydroxy mixed ethers disclosed therein are, without exception, preferably present as surfactant from group b) in the dishwashing agents preferred according to the invention.

The amounts in which the surfactants from groups a) and b) may be present in dishwashing agents preferred according to the invention vary depending on the desired product and are preferably within relatively narrow ranges. Particularly preferred machine dishwashing agents comprise a) 1.5 to 3.5% by weight, preferably 1.75 to 3.0% by weight and in particular 2.0 to 2.5% by weight, of nonionic surfactants from the group of alkoxylated alcohols, b) 4.5 to 20.0% by weight, preferably 5.0 to 15.0% by weight and in particular 7.0 to 10.0% by weight, of nonionic surfactants from the group of alkoxylated alcohols containing hydroxyl groups ("hydroxy mixed ethers").

For the purposes of the present invention, nonionic surfactants which may also preferably be used are terminally capped surfactants and nonionic surfactants with butyloxy groups. The first group includes, in particular, representatives of the formula $$R^1O[CH_2CH(R^3)O]_xR^2,$$

in which $R^1$ is a linear or branched, saturated or unsaturated, aliphatic or aromatic hydrocarbon radical having 1 to 30 carbon atoms, $R^2$ is a linear or branched, saturated or unsaturated, aliphatic or aromatic hydrocarbon radical having 1 to 30 carbon atoms, which is optionally substituted by 1, 2, 3, 4 or 5 hydroxy groups, and optionally by further ether groups, $R^3$ is —H or methyl, ethyl, n-propyl, isopropyl, n-butyl, isobutyl or tert-butyl, and x can assume values between 1 and 40. $R^2$ can optionally be alkoxylated, where the alkoxy group is preferably chosen from ethoxy, propoxy, butyloxy groups and mixtures thereof.

Preference is given here to surfactants of the formula given above in which $R^1$ is a $C_{9-11}$ or $C_{11-15}$-alkyl radical, $R^3$=H and x assumes a value from 8 to 15, while $R^2$ is preferably a straight-chain or branched saturated alkyl radical. Particularly preferred surfactants can be described by the formulae $C_{9-11}(EO)_8$-$C(CH_3)_2CH_2CH_3$, $C_{11-15}(EO)_{15}(PO)_6$-$C_{12-14}$, $C_{9-11}(EO)_8(CH_2)_4CH_3$.

Also suitable are mixed-alkoxylated surfactants, preference being given to those which have butyloxy groups. Such surfactants can be described by the formula $$R^1(EO)_a(PO)_b(BO)_c,$$

in which $R^1$ is a linear or branched, saturated or unsaturated, aliphatic or aromatic hydrocarbon radical having 1 to 30, preferably 6 to 20, carbon atoms, a represents values between 2 and 30, b represents values between 0 and 30 and c represents values between 1 and 30, preferably between 1 and 20.

Alternatively, the EO and PO groups in the formula above can also be swapped, meaning that surfactants of the general formula $$R^1(PO)_b(EO)_b(BO)_c,$$

in which $R^1$ is a linear or branched, saturated or unsaturated, aliphatic or aromatic hydrocarbon radical having 1 to 30, preferably 6 to 20, carbon atoms, a represents values between 2 and 30, b represents values between 0 and 30 and c represents values between 1 and 30, preferably between 1 and 20, can likewise be used with preference.

Particularly preferred representatives from this group of surfactants can be described by the formulae $C_{9-11}(PO)_3(EO)_{13}(BO)_{15}$, $C_{9-11}(PO)_3(EO)_{13}(BO)_6$, $C_{9-11}(PO)_3(EO)_{13}(BO)_3$, $C_{9-11}(EO)_{13}(BO)_6$, $C_{9-11}(EO)_{13}(BO)_3$, $C_{9-11}(PO)_3(EO)_{13}(BO)_3$, $C_{9-11}(EO)_8(BO)_3$, $C_{9-11}(EO)_8(BO)_2$, $C_{12-15}(EO)_7(BO)_2$, $C_{9-11}(EO)_8(BO)_2$, $C_{9-11}(EO)_8(BO)$. A particularly preferred surfactant of the formula $C_{13-15}(E)_{9-10}(BO)_{1-2}$ is commercially available under the name Plurafac® LF 221. A further particularly preferred surfactant with 10 EO and 2 ·BO is available under the trade name Genapol® 25 EB 102. With preference, it is also possible to use a surfactant of the formula $C_{12-13}(EO)_{10}(BO)_2$.

The nonionic surfactant(s) can be introduced into the agents according to the invention in different ways. The surfactants can, for example, be sprayed in the molten state onto the otherwise ready-formulated agent, or be added to the agent in the form of compounds or surfactant preparation forms.

There follows a description of the further ingredients which may be present in the machine dishwashing agents according to the invention, where the builders, as obligatory ingredient a), assume a particularly important role.

The most important ingredients of machine dishwashing agents are builders. In the cleaners according to the invention for machine dishwashing, all builders customarily used in washing and cleaners may be present, in particular thus zeolites, silicates, carbonates, organic cobuilders and also phosphates.

Suitable crystalline, layered sodium silicates have the general formula $NaMSi_xO_{2x+1}.H_2O$, where M is sodium or hydrogen, x is a number from 1.9 to 4 and y is a number from 0 to 20, and preferred values for x are 2, 3 or 4. Preferred crystalline phyllosilicates of the given formula are those in which M is sodium and x assumes the values 2 or 3. In particular, both β- and δ-sodium disilicates $Na_2Si_2O_5.yH_2O$ are preferred.

It is also possible to use amorphous sodium silicates having an $Na_2O:SiO_2$ modulus of from 1:2 to 1:3.3, preferably from 1:2 to 1:2.8 and in particular from 1:2 to 1:2.6, which have delayed solubility and secondary detergency properties. The dissolution delay relative to conventional amorphous sodium silicates can have been induced in various ways, for example by surface treatment, compounding, compaction/compression or by overdrying. Within the scope of this invention, the term "amorphous" also means "X-ray-amorphous". This means that in X-ray diffraction experiments, the silicates do not give sharp X-ray reflections typical of crystalline substances, but, at best, one or more maxima of the scattered X-ray radiation, which have a width of several degree units of the angle of diffraction. However, it is very probable that particularly good builder properties may result if, in electron diffraction experiments, the silicate particles give poorly defined or even sharp diffraction maxima. This is to be interpreted to the effect that the products have microcrystalline regions of size 10 to a few hundred nm, values up to a maximum of 50 nm and in particular up to a maximum of 20 nm being preferred. Particular preference is given to compressed/compacted amorphous silicates, compounded amorphous silicates and overdried X-ray-amorphous silicates.

The finely crystalline, synthetic zeolite which contains bonded water and which is used is preferably zeolite A and/or P. Zeolite P is particularly preferably Zeolith MAP® (commercial product from Crosfield). Also suitable, however, are zeolite X and mixtures of A, X and/or P. A zeolite which is commercially available and can be used with preference within the scope of the present invention is, for example, also a cocrystallisate of zeolite X and zeolite A (about 80% by weight of zeolite X), which is sold by CONDEA Augusta S.p.A. under the trade name VEGO-BOND AX® and can be described by the formula $$nNa_2O.(1-n)K_2O.Al_2O_3.(2-2.5)SiO_2.(3.5-5.5)H_2O.$$

Suitable zeolites have an average particle size of less than 10 μm (volume distribution; measurement method: Coulter counter) and preferably contain 18 to 22% by weight, in particular 20 to 22% by weight, of bonded water.

It is of course also possible to use the generally known phosphates as builder substances, provided such a use should not be avoided for ecological reasons. Of the large number of commercially available phosphates, the alkali metal phosphates, particularly preferably pentasodium or pentapotassium triphosphate (sodium or potassium tripolyphosphate), are of the greatest importance in the detergents and cleaners industry.

Alkali metal phosphates is the collective term for the alkali metal (in particular sodium and potassium) salts of the various phosphoric acids, among which metaphosphoric acids $(HPO_3)_n$ and orthophosphoric acid $H_3PO_4$, in addition to higher molecular weight representatives, may be differentiated. The phosphates combine a number of advantages: they act as alkali carriers, prevent limescale deposits on machine components, and lime incrustations in fabrics, and additionally contribute to the cleaning performance.

Sodium dihydrogenphosphate, $NaH_2PO_4$, exists as the dihydrate (density 1.91 $gcm^{-3}$, melting point 60°) and as the monohydrate (density 2.04 $gcm^{-3}$). Both salts are white powders which are very readily soluble in water, which lose the water of crystallization upon heating and undergo conversion at 200° C. into the weakly acidic diphosphate (disodium hydrogendiphosphate, $Na_2H_2P_2O_7$), at a higher temperature into sodium trimetaphosphate ($Na_3P_3O_9$) and Maddrell's salt (see below). $NaH_2PO_4$ is acidic; it is formed if phosphoric acid is adjusted to a pH of 4.5 using sodium hydroxide solution and the slurry is sprayed. Potassium dihydrogenphosphate (primary or monobasic potassium phosphate, potassium biphosphate, PDP), $KH_2PO_4$, is a white salt of density 2.33 $gcm^{-3}$, has a melting point of 253° [decomposition with the formation of potassium polyphosphate $(KPO_3)_x$] and is readily soluble in water.

Disodium hydrogenphosphate (secondary sodium phosphate), $Na_2HPO_4$, is a colorless, very readily water-soluble crystalline salt. It exists in anhydrous form and with 2 mol of water (density 2.066 $gcm^{-3}$, water loss at 95°), 7 mol of water (density 1.68 $gcm^{-3}$, melting point 48° with loss of $5H_2O$) and 12 mol of water (density 1.52 $gcm^{-3}$, melting point 35° with loss of $5H_2O$), becomes anhydrous at 100° and converts to the diphosphate $Na_4P_2O_7$ upon more severe heating. Disodium hydrogenphosphate is prepared by neutralizing phosphoric acid with soda solution using phenol-phthalein as indicator. Dipotassium hydrogenphosphate (secondary or dibasic potassium phosphate), $K_2HPO_4$, is an amorphous white salt which is readily soluble in water.

Trisodium phosphate, tertiary sodium phosphate, $Na_3PO_4$, are colorless crystals which as the dodecahydrate have a density of 1.62 $gcm^{-3}$ and a melting point of 73–76° C. (decomposition), as the decahydrate (corresponding to 19–20% of $P_2O_5$) have a melting point of 100° C. and in anhydrous form (corresponding to 39–40% of $P_2O_5$) have a density of 2.536 $gcm^{-3}$. Trisodium phosphate is readily soluble in water with an alkaline reaction and is prepared by evaporative concentration of a solution of exactly 1 mol of disodium phosphate and 1 mol of NaOH. Tripotassium phosphate (tertiary or tribasic potassium phosphate), $K_3PO_4$, is a white, deliquescent, granular powder of density 2.56 $gcm^{-3}$, has a melting point of 1340° and is readily soluble in water with an alkaline reaction. It is produced, for example, when Thomas slag is heated with charcoal and potassium sulfate. Despite the relatively high price, the more readily soluble and therefore highly effective potassium phosphates are often preferred in the cleaners industry over corresponding sodium compounds.

Tetrasodium diphosphate (sodium pyrophosphate), $Na_4P_2O_7$, exists in anhydrous form (density 2.534 $gcm^{-3}$, melting point 988°, 880° also reported) and as the decahydrate (density 1.815–1.836 $gcm^{-3}$, melting point 94° with loss of water). Both substances are colorless crystals which are soluble in water with an alkaline reaction. $Na_4P_2O_7$ is formed when disodium phosphate is heated at >200° or by reacting phosphoric acid with soda in the stoichiometric ratio and dewatering the solution by spraying. The decahydrate complexes heavy metal salts and water hardness constituents and therefore reduces the hardness of the water. Potassium diphosphate (potassium pyrophosphate), $K_4P_2O_7$, exists in the form of the trihydrate and is a colorless, hygroscopic powder with a density of 2.33 $gcm^{-3}$ which is soluble in water, the pH of the 1% strength solution at 25° being 10.4.

Condensation of the $NaH_2PO_4$ or of the $KH_2PO_4$ gives rise to higher molecular weight sodium and potassium phosphates, among which it is possible to differentiate between cyclic representatives, the sodium and potassium metaphosphates, and catenated types, the sodium and potassium polyphosphates. For the latter, in particular, a large number of names are in use: fused or calcined phosphates, Graham's salt, Kurrol's and Maddrell's salt. All higher sodium and potassium phosphates are referred to collectively as condensed phosphates.

The industrially important pentasodium triphosphate, $Na_5P_3O_{10}$ (sodium tripolyphosphate), is a nonhygroscopic, white, water-soluble salt which is anhydrous or crystallizes with $6H_2O$ and has the general formula NaO—[P(O)(ONa)—O]$_n$—Na where n=3. About 17 g of the anhydrous salt dissolve in 100 g of water at room temperature, about 20 g dissolve at 60° C., and about 32 g dissolve at 100°; after heating the solution for 2 hours at 100°, about 8% orthophosphate and 15% diphosphate are produced by hydrolysis. In the case of the preparation of pentasodium triphosphate, phosphoric acid is reacted with soda solution or sodium hydroxide solution in the stoichiometric ratio and the solution is dewatered by spraying. Similarly to Graham's salt and sodium diphosphate, pentasodium triphosphate dissolves many insoluble metal compounds (including lime soaps, etc.). Pentapotassium triphosphate, $K_5P_3O_{10}$ (potassium tripolyphosphate), is commercially available, for example, in the form of a 50% strength by weight solution (>23% $P_2O_5$, 25% $K_2O$). The potassium polyphosphates are widely used in the detergents and cleaners industry. There also exist sodium potassium tripolyphosphates, which can likewise be used within the scope of the present invention. These form, for example, when sodium trimetaphosphate is hydrolyzed with KOH:

$$(NaPO_3)_3+2\ KOH \rightarrow Na_3K_2P_3O_{10}+H_2O.$$

These can be used in accordance with the invention in exactly the same way as sodium tripolyphosphate, potassium tripolyphosphate or mixtures of the two; according to the invention, it is also possible to use mixtures of sodium tripolyphosphate and sodium potassium tripolyphosphate or mixtures of potassium tripolyphosphate and sodium potassium tripolyphosphate or mixtures of sodium tripolyphosphate and potassium tripolyphosphate and sodium potassium tripolyphosphate.

Organic cobuilders which may be used in the machine dishwashing agents according to the invention are, in particular, polycarboxylates/polycarboxylic acids, polymeric polycarboxylates, aspartic acid, polyacetals, dextrins, further organic cobuilders (see below), and phosphonates. These classes of substance are described below.

Organic builder substances which can be used are, for example, the polycarboxylic acids usable in the form of their sodium salts, the term polycarboxylic acids meaning carboxylic acids which carry more than one acid function. Examples of these are citric acid, adipic acid, succinic acid, glutaric acid, malic acid, tartaric acid, maleic acid, fumaric acid, sugar acids, aminocarboxylic acids, nitrilotriacetic acid (NTA), provided such a use is not objectionable on ecological grounds, and mixtures thereof. Preferred salts are the salts of the polycarboxylic acids such as citric acid, adipic acid, succinic acid, glutaric acid, tartaric acid, sugar acids and mixtures thereof.

The acids per se may also be used. In addition to their builder action, the acids typically also have the property of an acidifying component and thus also serve to establish a lower and milder pH of detergents or cleaners. In this connection, particular mention is made of citric acid, succinic acid, glutaric acid, adipic acid, gluconic acid and any mixtures thereof.

Also suitable as builders are polymeric polycarboxylates; these are, for example, the alkali metal salts of polyacrylic acid or of polymethacrylic acid, for example those having a relative molecular mass of from 500 to 70 000 g/mol.

The molar masses given for polymeric polycarboxylates are, for the purposes of this specification, weight-average molar masses $M_w$ of the respective acid form, determined fundamentally by means of gel permeation chromatography (GPC) using a UV detector. The measurement was made against an external polyacrylic acid standard which, owing to its structural similarity to the polymers under investigation, provides realistic molecular weight values. These figures differ considerably from the molecular weight values obtained using polystyrenesulfonic acids as the standard. The molar masses measured against polystyrenesulfonic acids are usually considerably higher than the molar masses given in this specification.

Suitable polymers are, in particular, polyacrylates which preferably have a molecular mass of from 2000 to 20 000 g/mol. Owing to their superior solubility, preference in this group may be given in turn to the short-chain polyacrylates which have molar masses of from 2000 to 10 000 g/mol and particularly preferably from 3000 to 5000 g/mol.

Also suitable are copolymeric polycarboxylates, in particular those of acrylic acid with methacrylic acid and of acrylic acid or methacrylic acid with maleic acid. Copolymers which have proven to be particularly suitable are those of acrylic acid with maleic acid which contain from 50 to 90% by weight of acrylic acid and 50 to 10% by weight of maleic acid. Their relative molecular mass, based on free acids, is generally 2000 to 70 000 g/mol, preferably 20 000 to 50 000 g/mol and in particular 30 000 to 40 000 g/mol, The (co)polymeric polycarboxylates can either be used as powders or as aqueous solutions. The (co)polymeric polycarboxylate content of the agents is preferably 0.5 to 20% by weight, in particular 3 to 10% by weight.

Particular preference is also given to biodegradable polymers of more than two different monomer units, for example those which contain, as monomers, salts of acrylic acid or of maleic acid, and vinyl alcohol or vinyl alcohol derivatives, or those which contain, as monomers, salts of acrylic acid and of 2-alkylallylsulfonic acid, and sugar derivatives.

Further preferred copolymers are those which preferably have, as monomers, acrolein and acrylic acid/acrylic acid salts or acrolein and vinyl acetate.

Further preferred builder substances which are likewise to be mentioned are polymeric aminodicarboxylic acids, salts thereof or precursor substances thereof. Particular preference is given to polyaspartic acids or salts and derivatives thereof, which also have a bleach-stabilizing effect as well as cobuilder properties.

Further suitable builder substances are polyacetals which can be obtained by reacting dialdehydes with polyolcarboxylic acids which have 5 to 7 carbon atoms and at least 3 hydroxyl groups. Preferred polyacetals are obtained from dialdehydes, such as glyoxal, glutaraldehyde, terephthalaldehyde, and mixtures thereof and from polyolcarboxylic acids, such as gluconic acid and/or glucoheptonic acid.

Further suitable organic builder substances are dextrins, for example oligomers or polymers of carbohydrates, which can be obtained by partial hydrolysis of starches. The hydrolysis can be carried out in accordance with customary processes, for example acid-catalyzed or enzyme-catalyzed processes. The hydrolysis products preferably have average molar masses in the range from 400 to 500 000 g/mol. Preference is given here to a polysaccharide with a dextrose equivalent (DE) in the range from 0.5 to 40, in particular from 2 to 30, where DE is a common measure of the reducing effect of a polysaccharide compared with dextrose, which has a DE of 100. It is also possible to use maltodextrins with a DE between 3 and 20 and dried glucose syrup with a DE between 20 and 37, and also so-called yellow dextrins and white dextrins with relatively high molar masses in the range from 2000 to 30 000 g/mol.

The oxidized derivatives of such dextrins are their reaction products with oxidizing agents which are able to oxidize at least one alcohol function of the saccharide ring to the carboxylic acid function. A product oxidized on the $C_6$ of the saccharide ring may be particularly advantageous.

Oxydisuccinates and other derivatives of disuccinates, preferably ethylenediaminedisuccinate, are also further suitable cobuilders. Here, ethylenediamine N,N'-disuccinate (EDDS) is preferably used in the form of its sodium or magnesium salts. In this connection, preference is also given to glycerol disuccinates and glycerol trisuccinates. Suitable use amounts in zeolite-containing and/or silicate-containing formulations are 3 to 15% by weight.

Further organic cobuilders which can be used are, for example, acetylated hydroxycarboxylic acids or salts thereof, which may also be present in lactone form and which contain at least 4 carbon atoms and at least one hydroxyl group and at most two acid groups.

A further class of substance with cobuilder properties is the phosphonates. These are, in particular, hydroxyalkane- and aminoalkanephosphonates. Among the hydroxyalkanephosphonates, 1-hydroxyethane-1,1-diphosphonate (HEDP) is of particular importance as cobuilder. It is preferably used as the sodium salt, the disodium salt giving a neutral reaction and the tetrasodium salt giving an alkaline reaction (pH 9). Suitable aminoalkanephosphonates are preferably ethylenediaminetetramethylenephosphonate (EDTMP), diethylenetriaminepentamethylenephoshonate (DTPMP) and higher homologs thereof. They are preferably used in the form of the neutrally reacting sodium salts, e g. as the hexasodium salt of EDTMP or as the hepta- and octasodium salt of DTPMP. Here, preference is given to using HEDP as builder from the class of phosphonates. In addition, the aminoalkanephosphonates have a marked heavy metal-binding capacity. Accordingly, particularly if the agents also comprise bleaches, it may be preferable to use aminoalkanephosphonates, in particular DTPMP, or mixtures of said phosphonates.

Moreover, all compounds which are able to form complexes with alkaline earth metal ions can be used as cobuilders.

As well as the builders, substances from the group of the surfactants (see above), the bleaches, the bleach activators, the enzymes, the polymers, and the dyes and fragrances, in particular, are important ingredients of cleaners. Important representatives from said classes of substance are described below.

Among the compounds which serve as bleaches and liberate $H_2O_2$ in water, sodium perborate tetrahydrate and sodium perborate monohydrate are of particular importance. Examples of further bleaches which may be used are sodium percarbonate, peroxypyrophosphates, citrate perhydrates and $H_2O_2$-supplying peracidic salts or peracids, such as perbenzoates, peroxophthalates, diperazelaic acid, phthaloiminoperacid or diperdodecanedioic acid. Cleaners according to the invention can also comprise bleaches from the group of organic bleaches. Typical organic bleaches are the diacyl peroxides, such as, for example, dibenzoyl peroxide. Further typical organic bleaches are the peroxy acids, particular examples being the alkylperoxy acids and the arylperoxy acids. Preferred representatives are (a) the peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid [phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyl-di(6-aminopercaproic acid) can be used.

Bleaches which may be used in the cleaners according to the invention for machine dishwashing may also be substances which liberate chlorine or bromine. Among the suitable materials which liberate chlorine or bromine, suitable examples include heterocyclic N-bromoamides and N-chloroamides, for example trichloroisocyanuric acid, tribromoisocyanuric acid, dibromoisocyanuric acid and/or dichloroisocyanuric acid (DICA) and/or salts thereof with cations such as potassium and sodium. Hydantoin compounds, such as 1,3-dichloro-5,5-dimethylhydantoin, are likewise suitable.

Said bleaches can also be introduced into the machine dishwashing agents according to the invention to achieve an "afterbleaching" in the clear rinse cycle entirely or partly via the rinse aid particles according to the invention.

Bleach activators, which assist the action of the bleaches, have already been mentioned above as a possible ingredient of the rinse aid particles. Known bleach activators are compounds which contain one or more N- or O-acyl groups, such as substances from the class of anhydrides, of esters, of imides and of acylated imidazoles or oximes. Examples are tetraacetylethylenediamine TAED, tetraacetylmethylenediamine TAMD and tetraacetylhexylenediamine TAHD, but also pentaacetylglucose PAG, 1,5-diacetyl-2,2-dioxohexahydro-1,3,5-triazine DADHT and isatoic anhydride ISA.

Bleach activators which can be used are compounds which, under perhydrolysis conditions, produce aliphatic peroxocarboxylic acids having preferably 1 to 10 carbon atoms, in particular 2 to 4 carbon atoms, and/or optionally substituted perbenzoic acid. Substances which carry O-acyl and/or N-acyl groups of said number of carbon atoms and/or optionally substituted benzoyl groups are suitable. Preference is given to polyacylated alkylenediamines, in particular tetraacetylethylenediamine (TAED), acylated triazine derivatives, in particular 1,5-diacetyl-2,4-dioxohexa-hydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), carboxylic acid anhydrides, in particular phthalic anhydride, acylated polyhydric alcohols, in particular triacetin, ethylene glycol diacetate, 2,5-diacetoxy-2,5-dihydrofuran, n-methylmorpholinium acetonitrile methylsulfate (MMA), and acetylated sorbitol and mannitol or mixtures thereof (SORMAN), acylated sugar derivatives, in particular pentaacetylglucose (PAG), pentaacetylfructose, tetraacetylxylose and octaacetyllactose, and acetylated, optionally N-alkylated, glucamine and gluconolactone, and/or N-acylated lactams, for example N-benzoylcaprolactam. Hydrophilically substituted acylacetals and acyllactams are likewise preferably used. Combinations of conventional bleach activators can also be used.

In addition to the conventional bleach activators, or instead of them, so-called bleach catalysts may also be incorporated into the rinse aid particles. These substances are bleach-boosting transition metal salts or transition metal complexes, such as, for example, Mn-, Fe-, Co-, Ru- or Mo-salen complexes or -carbonyl complexes. Mn, Fe, Co, Ru, Mo, Ti, V and Cu complexes with N-containing tripod ligands, and Co-, Fe-, Cu- and Ru-ammine complexes can also be used as bleach catalysts.

Preference is given to using bleach activators from the group of polyacylated alkylenediamines, in particular tetraacetylethylenediamine (TAED), N-acylimides, in particular N-nonanoylsuccinimide (NOSI), acylated phenolsulfonates, in particular n-nonanoyl- or isononanoyloxybenzensulfonate (n- or iso-NOBS), n-methylmorpholinium acetonitrile methylsulfate (MMA), preferably in amounts up to 10% by weight, in particular 0.1% by weight to 8% by weight, particularly 2 to 8% by weight and particularly preferably 2 to 6% by weight, based on the total agent.

Bleach-boosting transition metal complexes, in particular with the central atoms Mn, Fe, Co, Cu, Mo, V, Ti and/or Ru, preferably chosen from the group of manganese and/or cobalt salts and/or complexes, particularly preferably the cobalt (ammine) complexes, cobalt (acetato) complexes, cobalt (carbonyl) complexes, the chlorides of cobalt or manganese, manganese sulfate are used in customary amounts, preferably in an amount up to 5% by weight, in particular from 0.0025% by weight to 1% by weight and particularly preferably from 0.01% by weight to 0.25% by weight, in each case based on the total agent. However, in special cases, more bleach activator can also be used.

Suitable enzymes in the cleaners according to the invention are, in particular, those from the classes of hydrolases, such as the proteases, esterases, lipases or lipolytic enzymes, amylases, glycosyl hydrolases and mixtures of said enzymes. All of these hydrolases contribute to the removal of soilings such as protein-, grease- or starch-containing stains. For bleaching, it is also possible to use oxidoreductases. Especially suitable enzymatic active ingredients are those obtained from bacterial strains or fungi, such as *Bacillus subtilis, Bacillus licheniformis, Streptomyceus griseus, Coprinus cinereus* and *Humicola insolens*, and from genetically modified variants thereof. Preference is given to using proteases of the subtilisin type and in particular to proteases obtained from *Bacillus lentus*. Of particular interest here are enzyme mixtures, for example of protease and amylase or protease and lipase or lipolytic enzymes, or of protease, amylase and lipase or lipolytic enzymes, or protease, lipase or lipolytic enzymes, but in particular protease and/or lipase-containing mixtures or mixtures with lipolytic enzymes. Examples of such lipolytic enzymes are the known cutinases. Peroxidases or oxidases have also proven suitable in some cases. Suitable amylases include, in particular, alpha-amylases, isoamylases, pullulanases and pectinases.

The enzymes can be adsorbed on carrier substances or embedded in coating substances in order to protect them from premature decomposition. The proportion of enzymes, enzyme mixtures or enzyme granules can, for example, be about 0.1 to 5% by weight, preferably 0.5 to about 4.5% by weight.

Dyes and fragrances can be added to the machine dishwashing agents according to the invention in order to improve the esthetic impression of the resulting products and to provide the consumer with performance coupled with a visually and sensorally "typical and unmistakable" product. Perfume oils or fragrances which may be used are individual odorant compounds, e.g. the synthetic products of the ester, ether, aldehyde, ketone, alcohol and hydrocarbon type. Odorant compounds of the ester type are, for example, benzyl acetate, phenoxyethyl isobutyrate, p-tert-butylcyclohexyl acetate, linalyl acetate, dimethylbenzylcarbinyl acetate, phenylethyl acetate, linalyl benzoate, benzyl formate, ethyl methylphenylglycinate, allyl cyclohexylpropionate, styrallyl propionate and benzyl salicylate. The ethers include, for example, benzyl ethyl ether, and the aldehydes include, for example, the linear alkanals having 8–18 carbon atoms, citral, citronellal, citronellyloxyacetaldehyde, cyclamenaldehyde, hydroxycitronellal, lilial and bourgeonal, and the ketones include, for example, the ionones, α-isomethyl-ionone and methyl cedryl ketone, and the alcohols include anethol, citronellol, eugenol, geraniol, linalool, phenylethyl alcohol and terpineol, and the hydrocarbons include primarily the terpenes, such as limonene and pinene. Preference is, however, given to using mixtures of different odorants which together produce a pleasing scent note. Such perfume oils can also contain natural odorant mixtures, as are obtainable from plant sources, e.g. pine oil, citrus oil, jasmine oil, patchouli oil, rose oil and ylang ylang oil. Likewise suitable are muscatel, sage oil, camomile oil, oil of cloves, melissa oil, mint oil, cinnamon leaf oil, lime blossom oil, juniperberry oil, vetiver oil, olibanum oil, galbanum oil and labdanum oil, and orange blossom oil, neroliol, orange peel oil and sandalwood oil.

The fragrances can be incorporated directly into the cleaners according to the invention, although it may also be advantageous to apply the fragrances to carriers which enhance the adhesion of the perfume to the laundry and, by virtue of slower fragrance release, ensure long-lasting fragrance of the textiles. Materials which have become established as such carriers are, for example, cyclodextrins, in which case the cyclodextrin perfume complexes can additionally be coated with further auxiliaries. Incorporation of the fragrances into the rinse aid particles according to the invention is also possible and leads to a scent impression upon opening the machine (see above)

In order to improve the esthetic impression of the agents prepared according to the invention, it (or parts thereof) may be colored with suitable dyes. Preferred dyes, the choice of which does not present any problems at all to the person skilled in the art, have high storage stability and high insensitivity toward the other ingredients of the agents and toward light, and do not have marked substantivity toward the substrates to be treated with the agents, such as glass, ceramic or plastic dishware, in order not to dye these.

The cleaners according to the invention can comprise corrosion inhibitors to protect the ware or the machine, particular importance in the field of machine dishwashing being attached to silver protectants. It is possible to use the known substances of the prior art. In general, it is possible to use, in particular, silver protectants chosen from the group of triazoles, benzotriazoles, bisbenzotriazoles, aminotriazoles, alkylaminotriazoles and transition metal salts or transition metal complexes. Particular preference is given to the use of benzotriazole and/or alkylaminotriazole. Frequently encountered in cleaning formulations, moreover, are agents containing active chlorine, which can significantly reduce corrosion of the silver surface. In chlorine-free cleaners, use is made in particular of oxygen- and nitrogen-containing organic redox-active compounds, such as dihydric and trihydric phenols, e.g. hydroquinone, pyrocatechol, hydroxyhydroquinone, gallic acid, phloroglucinol, pyrogallol, and derivatives of these classes of compounds. Inorganic compounds in the form of salts and complexes, such as salts of the metals Mn, Ti, Zr, Hf, V, Co and Ce, are also often used. Preference is given here to the transition metal salts chosen from the group of manganese and/or cobalt salts and/or complexes, particularly preferably the cobalt (ammine) complexes, the cobalt (acetato) complexes, the cobalt (carbonyl) complexes, the chlorides of cobalt or manganese and mangense sulfate. It is likewise possible to use zinc compounds to prevent corrosion on the ware.

The agents according to the invention can be packaged directly after their manufacture and be sold as particulate cleaners. It is, however, also possible to compress the agents to give cleaner tablets or individual phases thereof in order to be able to provide the consumer with the compact supply form. Machine dishwashing agents which are characterized in that they are in the form of a tablet, preferably in the form of a multiphase tablet, in which the content of copolymer containing sulfonic acid groups in the individual phases is different, are further preferred embodiments of the present invention.

Preference is given here in particular to multiphase tablets, the multilayer tablets being of particular importance due to the fact that they are relatively easy to manufacture. The individual phases of such a shaped body can have different spatial shapes for the purposes of the present invention. The simplest realization possibility lies here in two- or multi-layered tablets, where each layer of the shaped body represents one phase. It is, however, also possible according to the invention to prepare multiphase shaped bodies in which individual phases have the form of intercalations in (an) other phase(s). As well as so-called "ring-core tablets", coated tablets or combinations of said embodiments are possible here, for example.

The shaped bodies according to the invention can assume any geometric shape, where in particular concave, convex, biconcave, biconvex, cubic, tetragonal, orthorhombic, cylindrical, spherical, cylinder-segment-like, discoid, tetrahedral, dodecahedral, octahedral, conical, pyramidal, ellipsoid, pentagon-, hexagon- and octagon-prismatic, and rhombohedral shapes are preferred. It is also possible to realize entirely irregular areas, such as arrow or animal shapes, trees, clouds, etc. If the shaped bodies according to the invention have corners and edges, then these are preferably rounded off. As additional visual differentiation, an embodiment having rounded corners and beveled ("chamfered") edges is preferred.

Instead of the layer structure, it is also possible to produce shaped bodies which include the copolymers containing sulfonic acid groups. Here, it has proven useful to produce base shaped bodies which have one or more cavity(ies), and to introduce the copolymers containing sulfonic acid groups either into the base tablet or into a "filling" of the cavity which is to be introduced later. This production process produces preferred multiphase cleaner shaped bodies which consist of a base shaped body which has a cavity, and a part which is at least partially contained in the cavity.

The cavity in the compressed part of such shaped bodies according to the invention can have any shape. It can divide the shaped body, i.e. have an opening on different sides, for example on the upper and lower side of the shaped body, but it can also be a cavity which does not go through the whole shaped body and whose opening is visible only from one side of the shaped body. The shape of the cavity can also be freely chosen within wide limits. For reasons of processing costs, holes which go right through and whose openings are on opposite surfaces of the shaped body, and indentations with an opening on one side of the shaped body have proven useful. In preferred washing and cleaner shaped bodies, the cavity has the shape of a hole which goes straight through, the openings of which are located on two opposite surfaces of the shaped body. The shape of such a hole which goes straight through can be freely chosen, preference being given to shaped bodies in which the hole which goes straight through has circular, ellipsoidal, triangular, rectangular, quadratic, pentagonal, hexagonal, heptagonal or octagonal horizontal sections. Completely irregular hole shapes, such as arrow or animal shapes, trees, clouds etc., can also be realized. As in the case of the shaped bodies, in the case of cornered holes, those with rounded corners and edges or with rounded corners and beveled edges are preferred.

The geometric realization forms given above can be combined with one another as desired. Thus, shaped bodies with a rectangular or quadratic basic area and circular holes can be produced, as can round shaped bodies with octagonal holes, there being no limit on the variety of combination possibilities. For reasons of processing costs and esthetic consumer perception, particular preference is given to shaped bodies with a hole in which the basic area of the shaped body and the cross section of the hole have the same geometric shape, for example shaped bodies with a quadratic basic area and centrally incorporated quadratic hole. Particular preference is given here to annular shaped bodies, i.e. circular shaped bodies with a circular hole.

Reducing the abovementioned principle of the hole open on two opposite sides of the shaped body to one opening gives depression shaped bodies. Washing and cleaner shaped bodies according to the invention in which the cavity has the shape of a depression are likewise preferred. As in the case of the "hole-shaped bodies", the shaped bodies according to the invention can also assume any geometric form for this embodiment, preference being given in particular to concave, convex, biconcave, biconvex, cubic, tetragonal, orthorhombic, cylindrical, spherical, cylinder-segment-like, discoid, tetrahedral, dodecahedral, octahedral, conical, pyramidal, ellipsoidal, pentagonal-, heptagonal- and octagonal-prismatic and rhombohedral shapes. Completely irregular basic areas, such as arrow or animal shapes, trees, clouds etc. can also be realized. If the shaped body has corners and edges, then these are preferably rounded off. As additional visual differentiation, an embodiment with rounded corners and beveled ("chamfered") edges is preferred.

The shape of the depression can also be freely chosen, preference being given to shaped bodies in which at least one depression can assume a concave, convex, cubic, tetragonal, orthorhombic, cylindrical, spherical, cylinder-segment-like, discoid, tetrahedral, dodecahedral, octahedral, conical, pyramidal, ellipsoid, pentagon-, hexagon- and octagon-prismatic and also rhombohedral shape. Entirely irregular depression shapes, such as arrow or animal shapes, trees, clouds, etc., can also be realized. As with the shaped bodies, depressions with rounded corners and edges or with rounded corners and beveled edges are preferred.

The size of the depression or of the hole which goes straight through relative to the whole shaped body is governed by the desired intended use of the shaped bodies. Depending on the amount of further active substance with which the remaining hollow volume is to be filled, the size of the cavity can be varied.

The base shaped body has, in preferred embodiments of the present invention, a high specific weight, for example above 1000 $kgdm^{-3}$, preferably above 1025 $kgdm^{-3}$, particularly preferably above 1050 $kgdm^{-3}$ and in particular above 1100 $kgdm^{-3}$.

In order to facilitate disintegration of highly compacted shaped bodies, it is possible to incorporate disintegration auxiliaries, so-called tablet disintegrants, into them in order to shorten the distintegration times. Tablet disintegrants or disintegration accelerators are understood, in accordance with Römpp (9th edition, vol. 6, p. 4440) and Voigt "*Lehrbuch der pharmazeutischen Technologie*" [Textbook of pharmaceutical technology] (6th edition, 1987, pp. 182–184), as meaning auxiliaries which ensure the rapid disintegration of tablets in water or gastric fluid and the release of the drugs in absorbable form.

These substances increase in volume upon the ingress of water, with on the one hand an increase in the intrinsic volume (swelling), on the other hand, by way of the release of gases as well, the possibility of generating a pressure which causes the tablet to disintegrate into smaller particles. Examples of established disintegration auxiliaries are carbonate/citric acid systems, with the use of other organic acids also being possible, Examples of swelling distintegration auxiliaries are synthetic polymers, such as polyvinylpyrrolidone (PVP) or natural polymers or modified natural substances, such as cellulose and starch and their derivatives, alginates or casein derivatives.

Preferred distintegrants used for the purposes of the present invention are disintegrants based on cellulose, so that preferred cleaner shaped bodies comprise a cellulose-based disintegrant in amounts of from 0.5 to 10% by weight, preferably 3 to 7% by weight and in particular 4 to 6% by weight.

The agents according to the invention can, moreover, comprise a gas-evolving effervescent system. The gas-evolving effervescent system may consist of a single substance which, upon contact with water, releases a gas. Among these compounds, mention is made in particular of magnesium peroxide, which releases oxygen upon contact with water. Usually, however, the gas-releasing effervescent system consists for its part of at least two constituents which react with one another to form gas. Although a multitude of systems which release, for example, nitrogen, oxygen or hydrogen are conceivable and implementable here, the effervescent system used in the washing and cleaner shaped bodies according to the invention will be selected on the basis of both economic and also ecological considerations. Preferred effervescent systems consist of alkali metal carbonate and/or alkali metal hydrogencarbonate, and also an acidifier which is suitable for releasing carbon dioxide from the alkali metal salts in aqueous solution.

In the case of the alkali metal carbonates and alkali metal hydrogencarbonates, the sodium and potassium salts are much preferred over the other salts for reasons of cost. It is of course not mandatory to use the pure alkali metal carbonates or alkali metal hydrogencarbonates in question; rather, mixtures of different carbonates and hydrogencarbonates may be preferred in the interests of washing performance.

In preferred cleaner shaped bodies, the effervescent system used comprises 2 to 20% by weight, preferably 3 to 15% by weight and in particular 5 to 10% by weight, of an alkali metal carbonate or alkali metal hydrogencarbonate, and 1 to 15% by weight, preferably 2 to 12% by weight and in particular 3 to 10% by weight, of an acidifier, in each case based on the total shaped body.

Examples of acidifiers which release carbon dioxide from the alkali metal salts in aqueous solution and which may be used are boric acid, and also alkali metal hydrogensulfates, alkali metal dihydrogenphosphates and other inorganic salts. Preference is given, however, to the use of organic acidifiers, with citric acid being a particularly preferred acidifier. However, it is also possible, in particular, to use the other solid mono-, oligo- and polycarboxylic acids. From this group, preference is in turn given to tartaric acid, succinic acid, malonic acid, adipic acid, maleic acid, fumaric acid, oxalic acid and polyacrylic acid. Organic sulfonic acids, such as amidosulfonic acid, can likewise be used. A product which is commercially available and which can likewise preferably be used as acidifier for the purposes of the present invention is Sokalan® DCS (trade mark of BASF), a mixture of succinic acid (max. 31% by weight), glutaric acid (max. 50% by weight) and adipic acid (max. 33% by weight).

For the purposes of the present invention, preference is given to cleaner shaped bodies in which the acidifier used in the effervescent system is a substance from the group of organic di-, tri- and oligocarboxylic acids, and mixtures thereof, A further preferred embodiment of the present invention provides a method for the production of machine dishwashing agents in which a solid polymer preparation form of a copolymer of i) unsaturated carboxylic acids ii) monomers containing sulfonic acid groups iii) optionally further ionic or nonionogenic monomers are mixed with further raw materials and/or compounds to give the machine dishwashing agent.

With regard to preferred chemical and physical parameters of the solid polymer preparation form, reference can be made to the above statements. As has already been mentioned above, tablets in particular are a preferred embodiment of the present invention. The invention therefore further provides a method for the production of cleaner tablets for machine dishwashing, in which a solid polymer preparation form of a copolymer of i) unsaturated carboxylic acids ii) monomers containing sulfonic acid groups iii) optionally further ionic or nonionogenic monomers are mixed with further raw materials and/or compounds and the mixture is then compressed to give tablets or phases thereof.

Irrespective of whether particulate or tableted agents are prepared, preference is given to methods according to the invention in which the mixture of raw materials and/or compounds, and solid copolymer preparation form comprises, based on the mixture, 0.1 to 70% by weight, preferably 0.25 to 50% by weight, particularly preferably 0.5 to 35% by weight, very particularly preferably 0.75 to 20% by weight and in particular 1 to 15% by weight of copolymers containing sulfonic acid groups.

The solid copolymer preparation form can consist of pure copolymer containing sulfonic acid groups. It is, however, also possible to use according to the invention a solid copolymer preparation form which, as well as containing the copolymer containing sulfonic acid groups, comprises other ingredients, for example carrier substances. Preference is given here to methods according to the invention in which the solid copolymer preparation form comprises the copolymer(s) containing sulfonic acid groups in amounts of more than 50% by weight, preferably of more than 60% by weight, particularly preferably of more than 75% by weight and in particular of more than 80% by weight, in each case based on the solid copolymer preparation form.

Further ingredients in such solid copolymer preparation forms can, in particular, be carrier materials which preferably originate from the group of the abovementioned builders. Also when using a solid copolymer preparation form which does not consist exclusively of polymers containing sulfonic acid groups (and water), preference is given to those preparation forms which satisfy certain criteria with regard to particle size, water content and bulk density. For further information, reference may be made here to the description of the agents according to the invention.

In summary, preference is also given to methods according to the invention in which at least 50% by weight, preferably at least 60% by weight, particularly preferably at least 75% by weight and in particular at least 90% by weight, of the particles of the solid copolymer preparation form have particle sizes above 200 $\mu$m, where particularly preferred methods are characterized in that at most 20% by weight, preferably at most 15% by weight and in particulate at most 10% by weight of the particles of the solid copolymer preparation form present in the agent have particle sizes below 200 $\mu$m or above 1200 $\mu$m. With regard to the water content, preference is given to methods according to the invention in which the water content of the particles of the solid copolymer preparation form is 3 to 12% by weight, preferably 4 to 11% by weight and in particular 5 to 10% by weight, in each case based on the copolymer particles.

While emphasis has been placed on the structures and compositions of the preferred embodiments of the invention, it will be appreciated that other embodiments, as well as modifications of the embodiments disclosed herein, can be made without departing from the principles of the invention. These and other modifications of the preferred embodiments, as well as other embodiments of the invention, will be obvious and suggested to those skilled in the art from the disclosure herein, whereby it is to be distinctly understood that the foregoing descriptive matter is to be interpreted merely as illustrative of the present invention and not as a limitation thereof.

All numbers expressing quantities or conditions are understood to be modified by "about." In addition, the indefinite articles "a" and "an" are understood to mean "at least one" or "one or more," unless otherwise specifically provided.

What is claimed:

1. A solid machine dishwashing agent comprising:

a) 1 to 99.9% by weight of a builder; and b) 0.1 to 70% by weight of a copolymer of:

i) 5 to 95% by weight of an unsaturated carboxylic acid; and ii) 5 to 95% by weight of a monomer containing sulfonic acid groups, wherein the copolomer containing sulfonic acid groups is in particulate form and at least 50% by weight of the particles of the copolymer containing sulfonic acid groups present in the agent have particle sizes above 200 $\mu$m.

2. A solid machine dishwashing agent comprising:

a) 1 to 99.9% by weight of a builder; and b) 0.1 to 70% by weight of a copolymer of:

i) 20 to 85% by weight of an unsaturated carboxylic acid;

iii) 10 to 60% by weight of a monomer containing sulfonic acid groups; and iv) 5 to 30% by weight of a further ionic or nonionic monomer or monomers, wherein the copolymer containing sulfonic acid groups is in particulate form and at least 50% by weight of the particles of the copolymer containing sulfonic acid groups present in the agent have particle sizes above 200 $\mu$m.

3. The machine dishwashing agent of claim 1, wherein at least 60% by weight of the particles of the copolymer containing sulfonic acid groups have particle sizes above 200 $\mu$m.

4. The machine dishwashing agent of claim 3, wherein at least 75% by weight of the particles of the copolymer containing sulfonic acid groups have particle sizes above 200 μm.

5. The machine dishwashing agent of claim 4, wherein at least 90% by weight of the particles of the copolymer containing sulfonic acid groups have particle sizes above 200 μm.

6. The machine dishwashing agent of claim 1, wherein at most 20% by weight of the particles of the copolymer containing sulfonic acid groups have particle sizes below 200 μm or above 1200 μm.

7. The machine dishwashing agent of claim 6, wherein at most 15% by weight of the particles of the copolymer containing sulfonic acid groups have particle sizes below 200 μm or above 1200 μm.

8. The machine dishwashing agent of claim 7, wherein at most 10% by weight, of the particles of the copolymer containing sulfonic acid groups have particle sizes below 200 μm or above 1200 μm.

9. The machine dishwashing agent of claim 1, wherein the water content of the particles of the copolymer containing sulfonic acid groups is 3 to 12% by weight, based on the copolymer particles.

10. The machine dishwashing agent of claim 9, wherein the water content of the particles of the copolymer containing sulfonic acid groups is 4 to 11% by weight, based on the copolymer particles.

11. The machine dishwashing agent of claim 10, wherein the water content of the particles of the copolymer containing sulfonic acid groups is 5 to 10% by weight, based on the copolymer particles.

12. The machine dishwashing agent of claim 1, wherein the bulk density of the particles of the copolymer containing sulfonic acid groups is 550 to 850 g/l.

13. The machine dishwashing agent of claim 12, wherein the bulk density of the particles of the copolymer containing sulfonic acid groups is 570 to 800 g/l.

14. The machine dishwashing agent of claim 13, wherein the bulk density of the particles of the copolymer containing sulfonic acid groups is 590 to 750 g/l.

15. The machine dishwashing agent of claim 14, wherein the bulk density of the particles of the copolymer containing sulfonic acid groups is 600 to 720 g/l.

16. The machine dishwashing agent of claim 1, comprising the copolymer containing sulfonic acid groups in amounts of from 0.25 to 50% by weight.

17. The machine dishwashing agent of claim 16, comprising the copolymer containing sulfonic acid groups in amounts of 0.5 to 35% by weight.

18. The machine dishwashing agent of claim 17, comprising the copolymer containing sulfonic acid groups in amounts of 0.75 to 20% by weight.

19. The machine dishwashing agent of claim 18, comprising the copolymer containing sulfonic acid groups in amounts of from 1 to 15% by weight.

20. The machine dishwashing agent of claim 1, further comprising 2 to 40% by weight of one or more ingredients with a melting or softening point below 60° C.

21. The machine dishwashing agent of claim 20, comprising 3 to 30% by weight of one or more ingredients with a melting or softening point below 60° C.

22. The machine dishwashing agent of claim 21, comprising 5 to 20% by weight of one or more ingredients with a melting or softening point below 60° C.

23. The machine dishwashing agent of claim 22, wherein the one or more ingredients with a melting or softening point below 60° C. comprise a nonionic surfactant.

24. The machine dishwashing agent of claim 1, in the form of a tablet.

25. The machine dishwashing agent of claim 24, in the form of a multiphase tablet, wherein each individual phase has a different content of copolymer containing sulfonic acid groups.

26. A method for the production of solid machine dishwashing agents, wherein a solid form of a copolymer of:

i) 5 to 95% by weight of an unsaturated carboxylic acid; and ii) 5 to 95% by weight of a monomer containing sulfonic acid groups is mixed with further raw materials and/or compounds to form the machine dishwashing agent, wherein at least 50% by weight of the particles of the copolymer containing sulfonic acid groups present in the agent have particle sizes above 200 μm.

27. A method for the production of solid machine dishwashing agents, wherein a solid form of a copolymer of:

ii) 20 to 85% by weight of an unsaturated carboxylic acid;

ii) 10 to 60% by weight of a monomer containing sulfonic acid groups; and iii) 5 to 30% by weight of a further ionic or nonionic monomer or monomers, is mixed with further raw materials and/or compounds to form the machine dishwashing agent, wherein at least 50% by weight of the particles of the copolymers containing sulfonic acid groups present in the agent have particle sites above 200 μm.

28. A method for the production of cleaner tablets for machine dishwashing, wherein a solid form of a copolymer of:

i) 5 to 95% by weight of an unsaturated carboxylic acid; and ii) 5 to 95% by weight of a monomer containing sulfonic acid groups is mixed with further raw materials and/or compounds and the mixture is then compressed to form a tablet or a phase thereof, wherein at least 50% by weight of the particles of the copolymer containing sulfonic acid groups present in the agent have particle sires above 200 μm.

29. A method for the production of cleaner tablets for machine dishwashing, wherein a solid polymer preparation form of a copolymer of:

i) 20 to 85% by weight of an unsaturated carboxylic acid;

ii) 10 to 60% by weight of a monomer containing sulfonic acid groups: and iii) 5 to 30% by weight of a further ionic or nonionic monomer or monomers, is mixed with further raw materials and/or compounds and the mixture is then compressed to form a tablet or a phase thereof, wherein at least 50% by weight of the particles of the copolymer containing sulfonic acid groups present in the agent have particle sizes above 200 μm.

30. The method of claim 26, wherein the mixture of raw materials and/or compounds and solid copolymer, based on the mixture, comprises 0.1 to 70% by weight of copolymers containing sulfonic acid groups.

31. The method of claim 26, wherein the mixture of raw materials and/or compounds and solid copolymer, based on the mixture, comprises 0.25 to 50% by weight of copolymers containing sulfonic acid groups.

32. The method of claim 31, wherein the mixture of raw materials and/or compounds and solid copolymer, based on the mixture, comprises 0.5 to 35% by weight of copolymers containing sulfonic acid groups.

33. The method of claim 32, wherein the mixture of raw materials and/or compounds and solid copolymer, based on the mixture, comprises 0.75 to 20% by weight of copolymers containing sulfonic acid groups.

34. The method of claim 33, wherein the mixture of raw materials and/or compounds and solid copolymer, based on the mixture, comprises 1 to 15% by weight of copolymers containing sulfonic acid groups.

35. The method of claim 26, wherein the solid copolymer form comprises the copolymer containing sulfonic acid groups in amounts of more than 50% by weight, based on the solid copolymer form.

36. The method of claim 35, wherein the solid copolymer form comprises the copolymer containing sulfonic acid groups in amounts of more than 60% by weight, based on the solid copolymer form.

37. The method of claim 36, wherein the solid copolymer form comprises the copolymer containing sulfonic acid groups in amounts of more than 75% by weight, based on the solid copolymer form.

38. The method of claim 37, wherein the solid copolymer form comprises the copolymer containing sulfonic acid groups in amounts of more than 80% by weight, based on the solid copolymer form.

39. The method of claim 26, wherein at least 60% by weight of the particles of the solid copolymer form have particle sizes above 200 $\mu$m.

40. The method of claim 39, wherein at least 75% by weight of the particles of the solid copolymer form have particle sizes above 200 $\mu$m.

41. The method of claim 40, wherein at least 90% by weight of the particles of the solid copolymer form have particle sizes above 200 $\mu$m.

42. The method of claim 26, wherein at most 20% by weight of the particles of the solid copolymer form have particle sizes below 200 $\mu$m or above 1200 $\mu$m.

43. The method of claim 42, wherein at most 15% by weight of the particles of the solid copolymer form have particle sizes below 200 $\mu$m or above 1200 $\mu$m.

44. The method of claim 43, wherein at most 10% by weight of the particles of the solid copolymer form have particle sizes below 200 $\mu$m or above 1200 $\mu$m.

45. The method of claim 26, wherein the water content of the particles of the solid copolymer form is 3 to 12% by weight, based on the copolymer particles.

46. The method of claim 45, wherein the water content of the particles of the solid copolymer form is 4 to 11% by weight, based on the copolymer particles.

47. The method of claim 46, wherein the water content of the particles of the solid copolymer form is 5 to 10% by weight, based on the copolymer particles.

* * * * *